US009180586B2

(12) United States Patent
Nemetz et al.

(10) Patent No.: US 9,180,586 B2
(45) Date of Patent: Nov. 10, 2015

(54) HANDLE ASSEMBLY FOR POWER TOOL

(75) Inventors: Uwe Nemetz, Hunfelden Nauheim (DE); Andreas Friedrich, Limburg (DE); Frantisek Harcar, Lipany (SK)

(73) Assignee: Black & Decker Inc., Newark, DE (US)

( * ) Notice: Subject to any disclaimer, the term of this patent is extended or adjusted under 35 U.S.C. 154(b) by 621 days.

(21) Appl. No.: 13/489,591

(22) Filed: Jun. 6, 2012

(65) Prior Publication Data

US 2012/0312571 A1 Dec. 13, 2012

(30) Foreign Application Priority Data

Jun. 7, 2011 (GB) ..... 1109494.3
Jul. 29, 2011 (GB) ..... 1113117.4

(51) Int. Cl.
*B25D 17/04* (2006.01)
*B25F 5/00* (2006.01)
*B25F 5/02* (2006.01)

(52) U.S. Cl.
CPC ..... *B25D 17/043* (2013.01); *B25F 5/006* (2013.01); *B25F 5/026* (2013.01)

(58) Field of Classification Search
CPC ..... B25D 17/24; B25D 17/043
USPC ..... 173/162.1, 162.2, 201, 210, 211; 16/426, 422
See application file for complete search history.

(56) References Cited

U.S. PATENT DOCUMENTS

| | | | | |
|---|---|---|---|---|
| 2,629,364 | A | 2/1953 | Anderson | |
| 4,972,733 | A * | 11/1990 | Olmr et al. | 74/551.9 |
| 2007/0143965 | A1 * | 6/2007 | Pfeiffer et al. | 16/422 |
| 2007/0143966 | A1 * | 6/2007 | Fischer | 16/422 |
| 2009/0000434 | A1 * | 1/2009 | Shinma et al. | 81/491 |
| 2009/0307875 | A1 * | 12/2009 | Nakashima et al. | 16/436 |
| 2010/0034482 | A1 * | 2/2010 | Jang et al. | 382/275 |

FOREIGN PATENT DOCUMENTS

| | | |
|---|---|---|
| EP | 0156387 | 10/1985 |
| EP | 1800805 | 6/2007 |

* cited by examiner

*Primary Examiner* — Hemant M Desai
*Assistant Examiner* — Nathaniel Chukwurah
(74) *Attorney, Agent, or Firm* — Adan Ayala

(57) ABSTRACT

A handle assembly for a power tool is disclosed. The handle assembly includes a base adapted to be mounted to a body of a power tool, and a handle having first and second mounting portions pivotably mounted to respective ends of the base. An elongate torsion spring has a first part mounted to the base and a respective second part mounted to each mounting portion such that pivoting of the handle relative to the base member causes twisting of the torsion member to resiliently oppose pivoting of the handle relative to the base portion.

11 Claims, 3 Drawing Sheets

HANDLE ASSEMBLY FOR POWER TOOL

CROSS-REFERENCE TO RELATED APPLICATIONS

Concurrently filed herewith is a U.S. application which has not yet been assigned a Ser. No., but which has the same inventive entity as the present invention, is entitled "Handle Assembly for Power Tool", claims priority from GB Patent Application Nos. GB 1109494.3 filed on 7 Jun. 2011 and GB 1113117.4 filed 29 Jul. 2011 in the name of Black & Decker Inc., and is incorporated herein by reference in its entirety. Furthermore, the present application claims priority from GB Patent Application Nos. GB 1109492.7 filed on 7 Jun. 2011 and GB 1113116.6 filed 29 Jul. 2011.

FIELD OF THE INVENTION

The present invention relates to a handle assembly for a power tool, and relates particularly, but not exclusively, to a vibration damping handle assembly for use with a hammer power drill.

BACKGROUND OF THE INVENTION

DE 102009000598 discloses a supplementary handle for a hammer power drill having a vibration damping arrangement comprising a torsion spring provided at each axial end of a mount for the handle.

This arrangement suffers from the drawback that the torsion springs must be highly robust, thereby increasing the cost of manufacture of the apparatus, and it is difficult to control the flexibility of the spring over a wide range of handle positions.

Preferred embodiments of the present invention seek to overcome one or more of the above disadvantages of the prior art.

BRIEF SUMMARY OF THE INVENTION

According to the present invention, there is provided a handle assembly for a power tool, the handle assembly comprising: a support member adapted to be mounted to a body of a power tool for supporting a handle on the power tool; a handle adapted to be pivotably mounted to the support member, wherein first and second mounting portions on one of the handle and the support member are pivotably mounted to respective ends of a third mounting portion on the other of the handle and the support member; and a vibration damping mechanism comprising at least one elongate biasing member having at least one respective resilient portion extending without coiling thereof from said first mounting portion to said second mounting portion and adapted to engage said third mounting portion such that pivoting of the handle relative to the support member causes deformation of said resilient portion causing said resilient portion to oppose said pivoting of the handle relative to the support member.

By providing a vibration damping mechanism comprising at least one elongate biasing member having at least one respective resilient portion extending without coiling thereof from said first mounting portion to said second mounting portion and adapted to engage said third mounting portion such that pivoting of the handle relative to the support member causes deformation of said resilient portion causing said resilient portion to oppose said pivoting of the handle relative to the support member, this provides the advantage of enabling simpler, more cost effective construction of the apparatus while enabling the apparatus to be more robust. The advantage is also provided of enabling greater control of the vibration damping properties over a wider range of handle positions.

At least one said biasing member may comprise a respective resilient rod. This provides the advantage of making the assembly more robust in construction.

The vibration damping mechanism may comprise a plurality of said rods.

Each end of at least one said rod may be located in a respective recess in said first and second mounting portion and the rod may be adapted to engage at least one protrusion on said third mounting portion.

The assembly may further comprise at least one fastener member for retaining said first mounting portion in position relative to said second mounting portion and extending along an axis of pivoting of said handle relative to said support member.

The vibration damping mechanism may comprise at least one elongate resilient torsion member having a first part mounted to the third mounting portion and a respective second part mounted to each of said first and second mounting portions such that pivoting of the handle relative to the support member causes twisting of the torsion member to resiliently oppose pivoting of the handle relative to the support member.

At least one said resilient torsion member may comprise at least one respective resilient sheet material.

This provides the advantage of enabling simpler construction of the resilient member by enabling it to be formed by stamping.

At least one said resilient torsion member may further comprise at least one enlarged portion adapted to be mounted to the support member and/or at least one mounting portion by means of screws.

This provides the advantage of enabling stresses applied to the resilient member to be spread over a larger surface area, thereby making the device more robust.

The handle and support member may be adapted to form a loop.

The apparatus may further comprise at least one limiting device for limiting pivoting movement of the handle relative to the support member.

At least one said limiting device may include at least one respective abutment member on the handle and/or the support member.

BRIEF DESCRIPTION OF THE DRAWINGS

Preferred embodiments of the invention will now be described, by way of example only and not in any limitative sense, with reference to the accompanying drawings, in which.

DETAILED DESCRIPTION OF THE INVENTION

Figure 1:
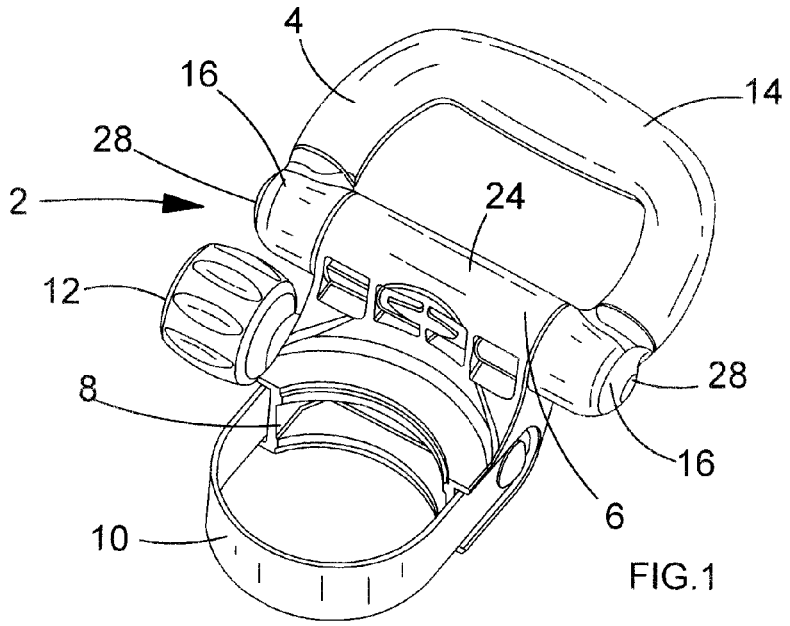
FIG. 1 is a perspective view of a handle assembly of a first embodiment of the present invention.
Figure 2:
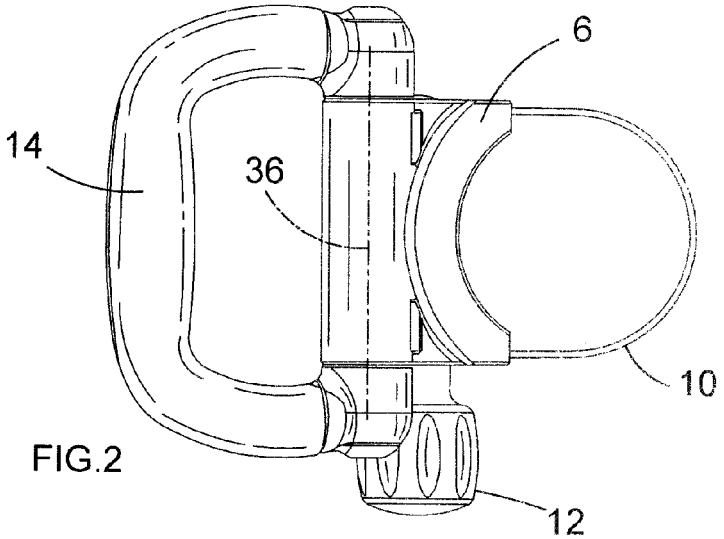
FIG. 2 is a top view of the assembly of FIG. 1.
Figure 3:
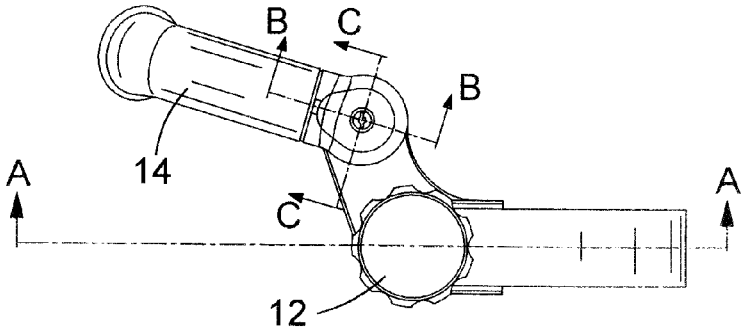
FIG. 3 is a side view of the assembly of FIG. 1.
Figure 4:
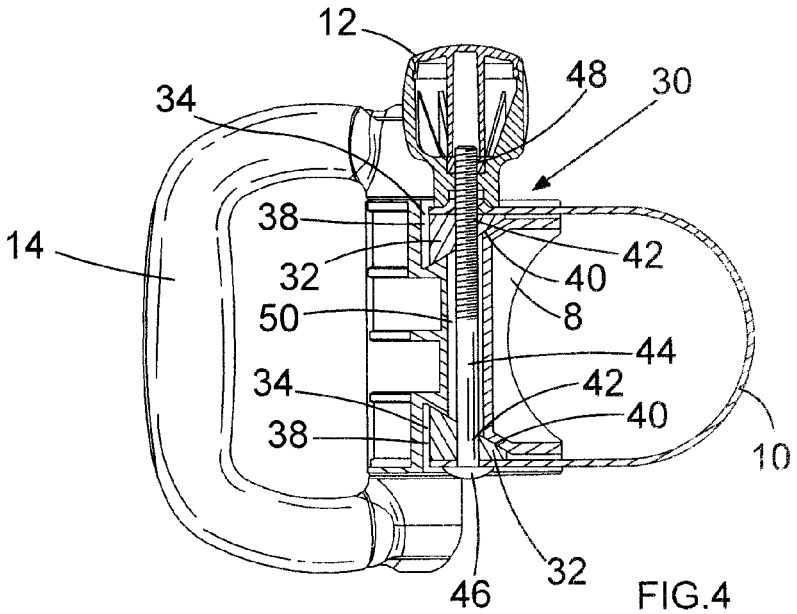
FIG. 4 is a cross sectional view along the line A-A in FIG. 3.
Figure 5:
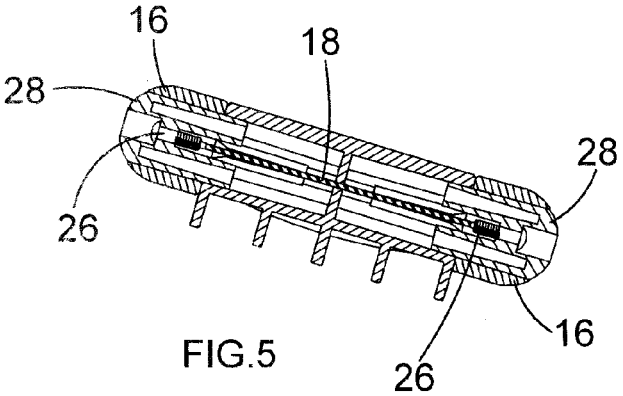
FIG. 5 is a cross sectional view along the line C-C in FIG. 3.
Figure 6:
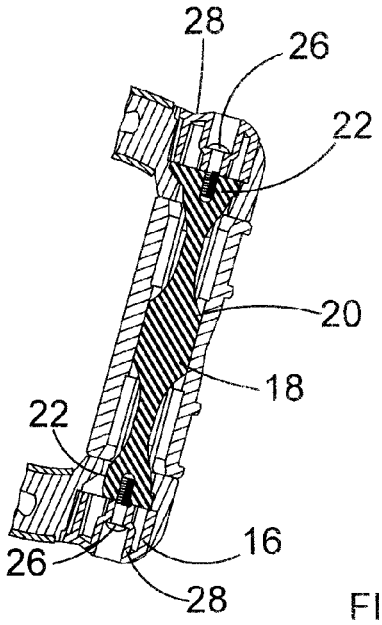
FIG. 6 is a cross sectional view along the line B-B in FIG. 3.
Figure 7:
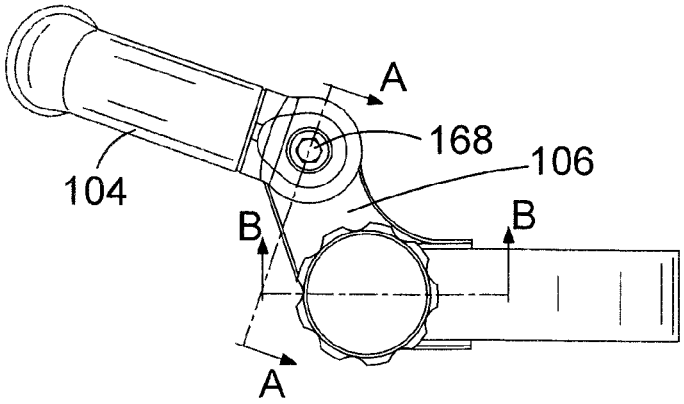
FIG. 7 is a side view of a handle assembly of a second embodiment of the present invention.
Figure 8:
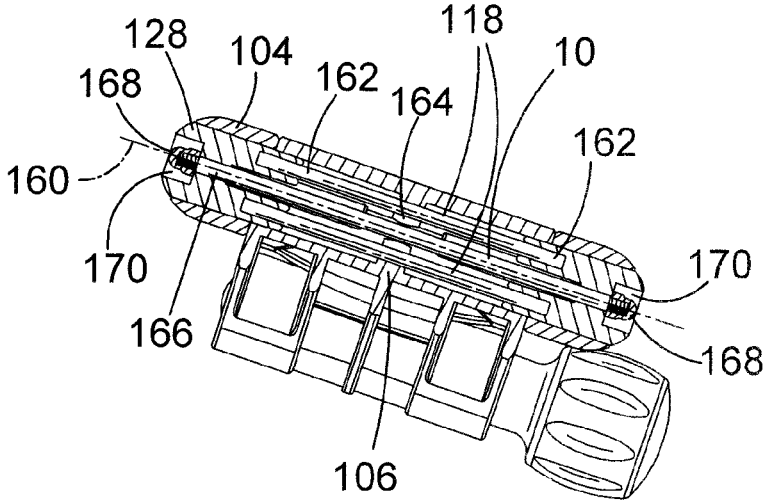
FIG. 8 is a cross sectional view along the line A-A in FIG. 7.
Figure 9:
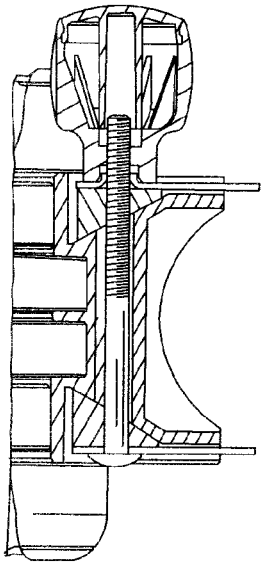
FIG. 9 is a cross sectional view along the line B-B in FIG. 7.
Figure 10:
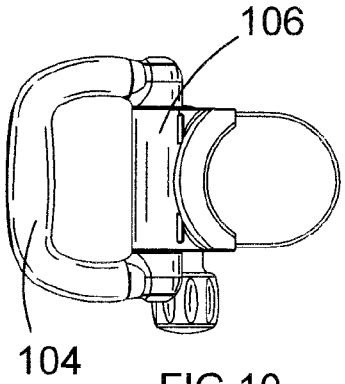
FIG. 10 is a top view of the assembly of FIG. 7.

Referring to FIGS. 1 to 6, a handle assembly 2 for mounting a handle 4 to a forward part of a housing (not shown) of a power tool such as a hammer drill comprises a support member comprising a base 6 of durable plastics material having a generally partially cylindrical part 8 for abutting the housing of the power tool, and a flexible metal strap 10 which wraps around the housing to retain the base 6 in position on the housing. The strap 10 is tightened or slackened by means of a rotatable knob 12. The handle 4 has a grip 14 of suitable plastics material and first and second mounting parts 16 pivotably attached to the base 6 by means of a torsion spring 18 (FIGS. 5 and 6). The torsion spring 18 comprises a flat sheet of resilient metal such as steel having a central enlarged portion 20 and enlarged portions 22 at its ends.

The mounting parts 16 of the handle 4 are pivotably mounted to a third mounting part 24 on the base 6 such that the enlarged portions 22 of the torsion spring 18 are received in respective first and second mounting parts 16. The enlarged portions 22 of the torsion spring 18 are attached to the first and second mounting parts 16 by means of screws 26, and the enlarged portion 20 at the centre of the torsion spring 18 is attached to the third mounting part 24 by means of a screw (not shown). The ends of the first and second mounting parts 16 are closed by end caps 28 which are slidably received in respective apertures in the mounting parts 16.

When no load is applied to the grip 14, the torsion spring 18 remains flat and the grip 14 remains in its rest position. However, when pressure is applied to the grip 14, the mounting parts 16 at the respective ends of the grip 14 cause the enlarged portions 22 at the ends of the torsion spring 18 to twist around the longitudinal axis of the torsion spring 18 relative to the enlarged portion 20 at the centre of the torsion spring 18, and twisting movement of the torsion spring 18 damps the transmission of vibrations from the body of the power tool via the base 6 to the grip 14.

Referring now to FIG. 4, a clamping mechanism 30 for mounting the base 6 to the housing of the power tool is shown in greater detail. The clamping mechanism 30 includes a pair of wedges 32 of triangular cross section which are attached to respective ends of the metal strap 10. The wedges 32 are located in respective recesses 34 in the base 6, the length of the recess 34 in a direction transverse to the pivot axis 36 of the grip 14 being longer than the wedge 32. As a result, a gap 38 is provided between the end of the recess 34 and the end of the wedge 32, and each wedge 32 is slidable relative to the base 6 by means of inclined surfaces 40 on the base 6. Each wedge 32 is provided with an aperture 42 through which a bolt 44 passes, the bolt 44 extending from a head 46 which non-rotatably engages the external surface of the base 6, through the wedges 32 and through an aperture 50 through the base 6, and engages an internal bore 48 in the rotatable knob 12 by means of mutually engaging screw threads on the end of the bolt 44 and the internal bore 48 of the knob 12. Rotation of the knob 12 in a first direction causes the knob 12 to move axially along the bolt 44, urging the wedges 32 towards each other. As a result, the wedges 32 slide along the inclined surfaces 40 on the base 6 and move away from the part cylindrical support 8 on the base 6. This draws the ends of the metal strap 10 with the wedges 32 into the base 6, as a result of which the length of the strap 10 is shortened and the strap 10 is tightened around the housing of the power tool to clamp the handle 4 in position relative to the housing. The aperture 50 through the base 6 has an elongated cross section, such as an oval shape, to accommodate movement of the bolt 44 in a transverse direction relative to the axis 36 of rotation of the grip 14. Rotation of the knob 12 in the opposite direction enables the wedges 32 to be moved in an opposite direction relative to the base 6 to loosen the strap 10 around the housing of the tool to enable the position of the handle 4 to be adjusted.

FIGS. 7 to 10 show a second embodiment of a handle assembly of the present invention, in which parts common to the embodiment of FIGS. 1 to 6 are denoted by like reference numerals but increased by 100.

In the embodiment of FIGS. 7 to 10, the torsion spring 18 of the embodiment of FIGS. 1 to 6 is replaced by a pair of spring rods 118 located parallel to and spaced from pivot axis 160 of handle 104 relative to base 106. Each end of the spring rods 118 is located in a respective recess 162 of a side handle cap 128 and engages a protrusion 164 in the side handle base 106. The side handle caps 128 are held in position by means of a threaded rod 166 extending along the pivot axis 160 and a cap nut 168 being located at each end of the threaded rod 166 in a respective recess 170 in the side handle cap 128.

As the side handle 104 is pivoted about the pivot axis 160 relative to the base 106, the spring rods 118 are bent as a result of the change in circumferential position of the recesses 162 at the ends of the rods 118 relative to the protrusions 164 between the ends of the rods 118, and the resilience of the spring rods 118 resists this pivoting motion and damps vibrations passing from the tool housing to the handle 104.

It will be appreciated by persons skilled in the art that the above embodiment has been described by way of example only and not in any limitative sense, and that various alterations and modifications are possible without departure from the scope of the invention as defined by the appended claims. For example, it is possible to replace the threaded rod 166 of the embodiment of FIGS. 7 to 10 by a rod having a single screw thread and a single cap nut 168 at one end.

The invention claimed is:

1. A handle assembly for a power tool, the handle assembly comprising:

a support member adapted to be mounted to a body of a power tool for supporting a handle on the power tool;

a handle adapted to be pivotably mounted to the support member, wherein first and second mounting portions on one of the handle and the support member are pivotably mounted to respective ends of a third mounting portion on the other of the handle and the support member, the first and second mounting portions defining an axis of pivoting of said handle relative to said support member; and a vibration damping mechanism comprising at least one elongate biasing member having at least one respective resilient portion extending without coiling thereof from said first mounting portion to said second mounting portion and adapted to engage said third mounting portion such that pivoting of the handle relative to the support member about the axis of pivoting causes torsional deformation of said resilient portion, causing said resilient portion to oppose said pivoting of the handle relative to the support member about the axis of pivoting;

wherein the vibration damping mechanism comprises at least one elongate resilient torsion member having a first part mounted to the third mounting portion and a respective second part mounted to each of said first and second mounting portions such that pivoting of the handle relative to the support member causes twisting of the torsion member to resiliently oppose a pivoting of the handle relative to the support member; and wherein at least one said resilient torsion member further comprises at least one enlarged portion adapted to be mounted to one or more of the base portion, the first mounting portion, and the second mounting portion.

2. A handle assembly for a power tool, the handle assembly comprising:

a support member adapted to be mounted to a body of a power tool for supporting a handle on the power tool;

a handle adapted to be pivotably mounted to the support member, wherein first and second mounting portions on one of the handle and the support member are pivotably mounted to respective ends of a third mounting portion on the other of the handle and the support member; and a vibration damping mechanism comprising at least one elongate biasing member having at least one respective resilient portion extending without coiling thereof from said first mounting portion to said second mounting portion and adapted to engage said third mounting portion such that pivoting of the handle relative to the support member causes deformation of said resilient portion causing said resilient portion to oppose said pivoting of the handle relative to the support member;

wherein the vibration damping mechanism comprises at least one elongate resilient torsion member having a first part mounted to the third mounting portion and a respective second part mounted to each of said first and second mounting portions such that pivoting of the handle relative to the support member causes twisting of the torsion member to resiliently oppose pivoting of the handle relative to the support member; and wherein at least one said resilient torsion member comprises at least one respective resilient sheet material.

3. The assembly according to claim 2, wherein at least one said biasing member comprises a respective resilient rod.

4. The assembly according to claim 3, wherein the vibration damping mechanism comprises a plurality of said rods.

5. The assembly according to claim 3, wherein each end of at least one said rod is located in a respective recess in said first and second mounting portion and the rod is adapted to engage at least one protrusion on said third mounting portion.

6. The handle assembly according to claim 2, wherein the at least one elongate biasing member comprises the at least one elongate resilient torsion member.

7. A handle assembly for a power tool, the handle assembly comprising:

a support member adapted to be mounted to a body of a power tool for supporting a handle on the power tool;

a handle adapted to be pivotably mounted to the support member, wherein first and second mounting portions on one of the handle and the support member are pivotably mounted to respective ends of a third mounting portion on the other of the handle and the support member; and a vibration damping mechanism comprising at least one elongate resilient torsion member comprising a resilient sheet material, the elongate resilient torsion member having at least one respective resilient portion extending from said first mounting portion to said second mounting portion and adapted to engage said third mounting portion such that pivoting of the handle relative to the support member causes deformation of said resilient torsion member causing said resilient torsion member to oppose said pivoting of the handle relative to the support member.

8. The assembly according claim 7, further comprising at least one fastener member for retaining said first mounting portion in position relative to said second mounting portion and extending along the axis of pivoting of said handle relative to said support member.

9. The assembly according to claim 7, wherein the handle and support member are adapted to form a loop.

10. The assembly according to claim 7, further comprising at least one limiting device for limiting pivoting movement of the handle relative to the support member.

11. The assembly according to claim 10, wherein at least one said limiting device includes at least one respective abutment member on one or more of the handle and the support member.

* * * * *